US010051966B2

(12) United States Patent
Zhao

(10) Patent No.: US 10,051,966 B2
(45) Date of Patent: Aug. 21, 2018

(54) HANGING BASKET CHAIR

(71) Applicant: Hangzhou Zhaos IMP. & EXP. Co., Ltd., Hangzhou, Zhejiang (CN)

(72) Inventor: Fujian Zhao, Zhejiang (CN)

(73) Assignee: Hangzhou Zhaos IMP & EXP. Co., Ltd., Hanzhou, Zheijiang (CN)

( * ) Notice: Subject to any disclaimer, the term of this patent is extended or adjusted under 35 U.S.C. 154(b) by 0 days.

(21) Appl. No.: 14/922,621

(22) Filed: Oct. 26, 2015

(65) Prior Publication Data

US 2016/0120317 A1 May 5, 2016

(30) Foreign Application Priority Data

Nov. 3, 2014 (CN) ..... 2014 2 0649446 U

(51) Int. Cl.
*A47C 5/00* (2006.01)
*A47C 3/16* (2006.01)
*A47C 3/025* (2006.01)

(52) U.S. Cl.
CPC ..... *A47C 3/16* (2013.01); *A47C 3/0255* (2013.01); *A47C 5/00* (2013.01)

(58) Field of Classification Search
CPC ..... A47C 3/16; A47C 3/0255; A47C 5/00
USPC ..... 297/283, 273, 274, 275; 182/187; 224/158
See application file for complete search history.

(56) References Cited

U.S. PATENT DOCUMENTS 3,841,543 A * 10/1974 Bolton ..... A61G 1/00 224/158
5,366,125 A * 11/1994 Procido ..... A47K 5/00 206/77.1
5,857,598 A * 1/1999 Dunne ..... A47D 13/025 224/158
6,213,362 B1 * 4/2001 Lorenzini ..... A47D 13/02 224/158
2008/0060128 A1 * 3/2008 Forshpan ..... A47D 13/107 5/98.3

(Continued)

*Primary Examiner* — Syed A Islam
(74) *Attorney, Agent, or Firm* — Muncy, Geissler, Olds & Lowe, P.C.

(57) ABSTRACT

The technical problem to be solved by the invention is to provide a hanging basket chair, including a hanging basket part, wherein the hanging basket part includes a skeleton belt (1), a top fabric decoration body (21) and a fabric hanging basket body (22) shaped like a pocket; both the top fabric decoration body and the fabric hanging basket body are connected to the skeleton belt by suturing; the upper part of the skeleton belt is sutured into a connecting ring (11) for hooking; the body of the skeleton belt is positioned at the pocket mouth (4) of the pocket, forming an annular pocket mouth brim. The invention has the following beneficial effects: the internal skeleton belt actually is the part under force although the invention in appearance is made up of a top and a body by suturing, the weight is evenly shared by the skeleton belt, compared with the method for bearing stress only by the suture between the top and the body , the invention is more reliable in bearing capacity and is unbreakable; the invention is made of fabrics on the whole, occupies little space during hanging, and convenient for folding and storage; the invention is made of soft material, which is more suitable for babies, preventing babies from injury.

8 Claims, 3 Drawing Sheets

(56) References Cited

U.S. PATENT DOCUMENTS

| | | | | |
|---|---|---|---|---|
| 2015/0018108 | A1* | 1/2015 | Lacy | A63H 33/008<br>472/136 |
| 2015/0030790 | A1* | 1/2015 | Duncan, III | E04H 15/04<br>428/34.1 |

* cited by examiner

HANGING BASKET CHAIR

TECHNICAL FIELD

The invention relates to a hanging basket chair, and more particularly, to a household hanging basket chair.

BACKGROUND OF THE INVENTION

With the improvement of living standards, more and more families need household decorations characterized by decorativeness, enjoyment and practicability. The existing household hanging basket chair generally is made of rattan, fixed in size and large in area occupied. Besides, in winter it may be cold to lie in a hanging basket chair made of rattan.

SUMMARY OF THE INVENTION

The technical problem to be solved by the invention is to provide a hanging basket chair, which is convenient for assembly and replacement of parts. For this purpose, the invention adopts the following technical solution.

A hanging basket chair, including a hanging basket part, wherein the hanging basket part includes a skeleton belt, a top fabric decoration body and a fabric hanging basket body shaped like a pocket; both the top fabric decoration body and the fabric hanging basket body are connected to the skeleton belt by suturing; the upper part of the skeleton belt is sutured into a connecting ring for hooking; the body of the skeleton belt is positioned at the pocket mouth of the pocket, forming an annular pocket mouth brim.

On the basis of adoption of the technical solution mentioned above, the invention also can further adopt such a technical solution as below:

The upper part of the skeleton belt is wrapped by the top fabric decoration body, and the hook part of the skeleton belt is exposed out of the top fabric decoration body.

The hanging basket chair also includes a seat cushion which is positioned at the bottom of the inside of the fabric hanging basket body shaped like a pocket.

The hanging basket part is shaped like animal cartoons, and the top fabric decoration body is shaped like animal heads or rumps.

The top fabric decoration body is internally filled with elastic fillers.

The top fabric decoration body is connected to the fabric hanging basket body by suturing, the body of the skeleton belt passes through the suture between the top fabric decoration body and the fabric hanging basket body, forming the annular pocket mouth brim.

The hanging basket chair is also provided with a hanging basket chair support for hooking the connecting ring.

Due to adoption of the technical solution of the invention, the invention has the following beneficial effects: (1) the internal skeleton belt actually is the part under force although the invention in appearance is made up of the top and the body by suturing, the weight is evenly shared by the skeleton belt and the center of gravity of a sitter is positioned at the rear side of the pocket mouth along the skeleton belt, thus improving the use experience of the sitter in a freely rocking leisure state, compared with the method for bearing stress only by the top and the body suture, the invention is more reliable in bearing capacity and is unbreakable; (2) the invention is made of fabrics on the whole, occupies little space during hanging, and convenient for folding and storage; (3) the invention is made of soft material, which is more suitable for babies, preventing babies from injury.

DETAILED DESCRIPTION OF THE EMBODIMENTS

Figure 1:
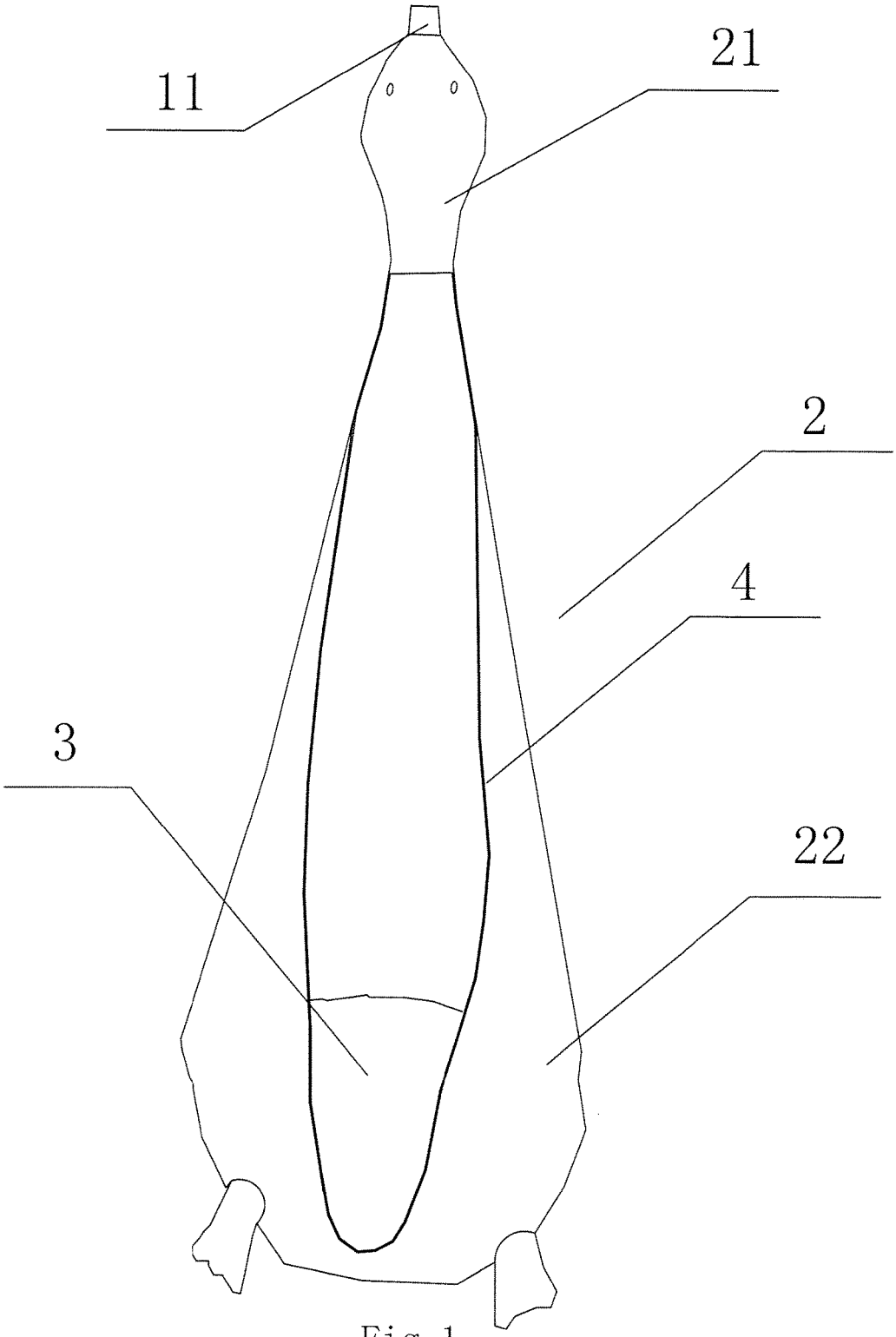
FIG. 1 shows a hanging basket chair according to an embodiment of the invention, in which a hanging basket chair support is omitted.
Figure 2:
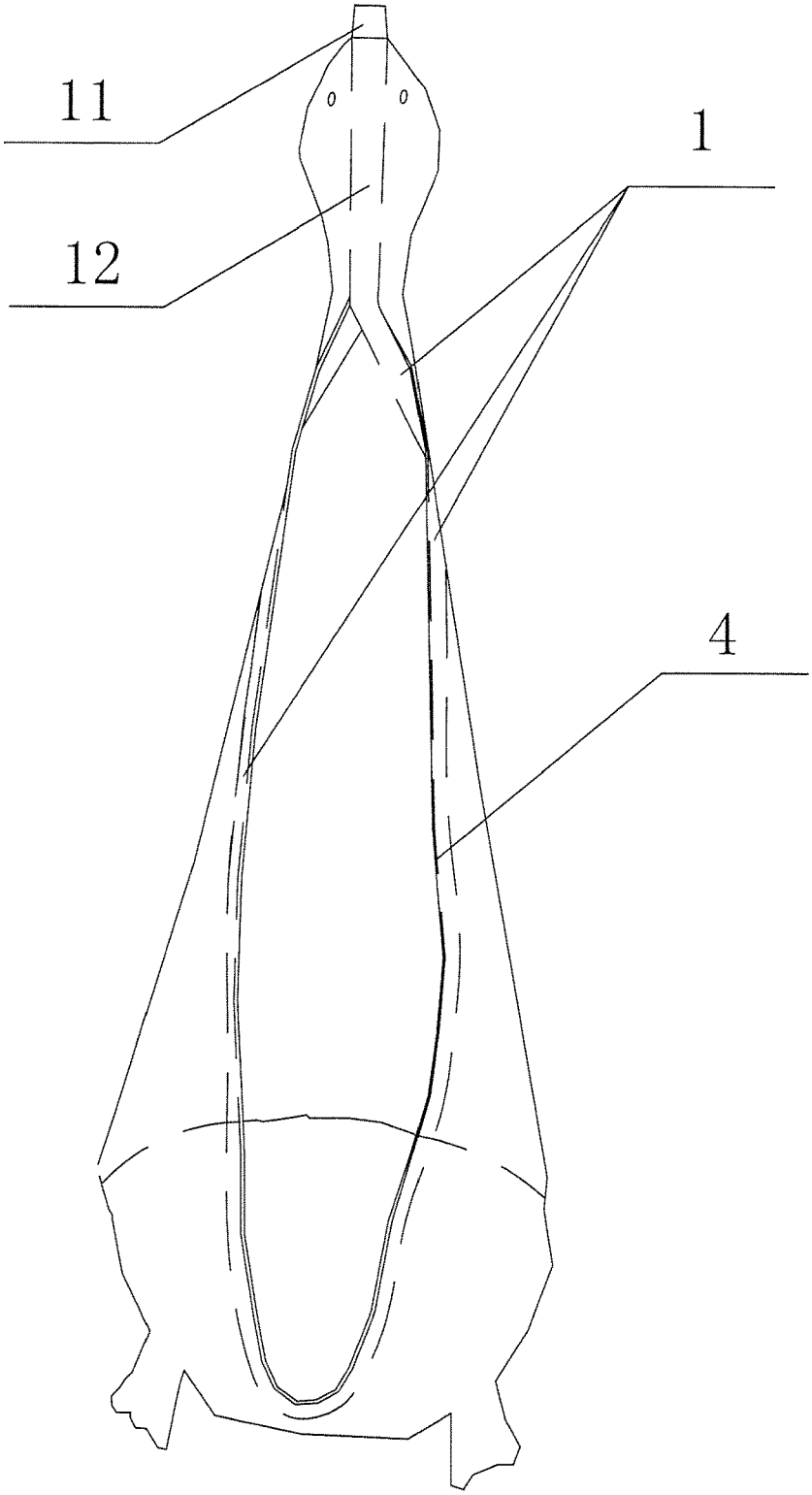
FIG. 2 is a front perspective drawing of a hanging basket chair according to an embodiment of the invention.
Figure 3:
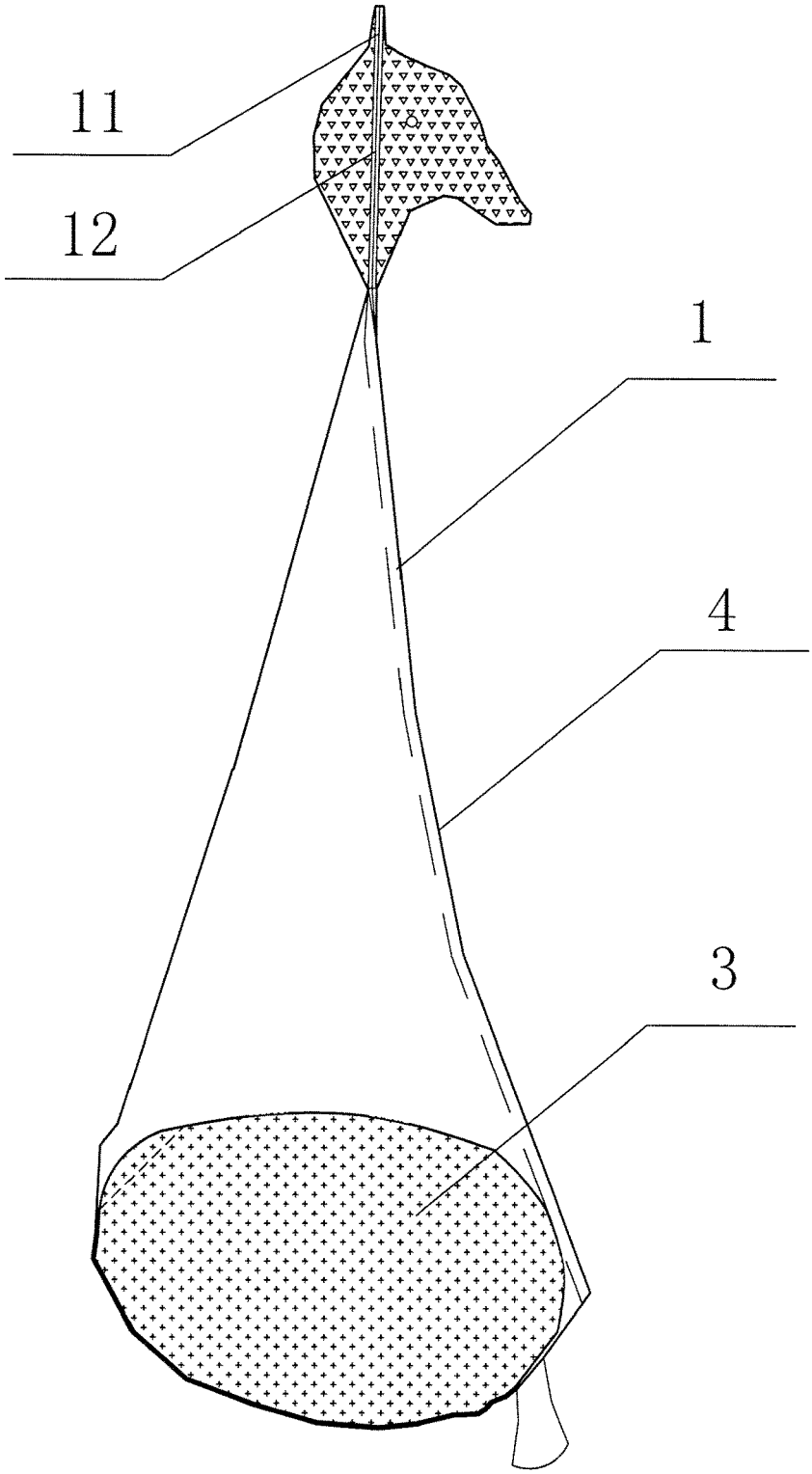
FIG. 3 is a side perspective drawing of a hanging basket chair according to an embodiment of the invention.

Referring to accompanying drawings, there is shown a hanging basket chair according to an embodiment of the invention, including a skeleton belt 1, a fabric hanging basket 2 and a seat cushion 3; the fabric hanging basket includes a top fabric decoration body 21 and a fabric hanging basket body 22; the skeleton belt 1 penetrates into the fabric hanging basket 2 from the top 21; the upper part of the skeleton belt 1 is sutured into a connecting ring 11 for hooking; a part of the connecting ring 11 is exposed out at the central position at the upper end of the top 21, and the connecting ring 11 is configured to hook on a support. Reference number 12 refers to the sutured part of the skeleton belt 1.

The body of the skeleton belt 1 is positioned at the pocket mouth 4 of the pocket, forming an annular pocket mouth brim. The fabric hanging basket body 22 is connected to the top 21 by suturing, and the pocket mouth 4 also includes decorative edges provided along the pocket mouth brim and decorations. The fabric hanging basket body 22 is shaped like a pocket, and the seat cushion 3 is placed on the bottom of the body 22 shaped like a pocket; the skeleton belt 1 servers as the integrated main stress skeleton, and the body shaped like a pocket disperses force. The center of gravity of a sitter is positioned at the rear side of the pocket mouth along the skeleton belt, thus improving the use experience of the sitter in a freely rocking leisure state.

The fabric hanging basket is shaped like animals, and the top 21 is shaped like animal heads or rumps.

The top 21 is internally filled with elastic fillers.

The invention claimed is:

1. A hanging basket chair, comprising:

a hanging basket part, wherein the hanging basket part comprises:

a skeleton belt;

a top fabric decoration body; and a fabric hanging basket body forming a pocket;

wherein both the top fabric decoration body and the fabric hanging basket body are connected to the skeleton belt, and wherein the skeleton belt extends from a top of the top fabric decoration body to a bottom of the fabric hanging basket body to form an integrated annular pocket mouth brim at a mouth of the fabric hanging basket body, wherein an upper part of the skeleton belt is formed into a connecting ring for hooking, and wherein the upper part of the belt is enclosed by the top fabric decoration body with the connecting ring of the belt exposed out of the top fabric decoration body.

2. The hanging basket chair according to claim 1, wherein both the top fabric decoration body and the fabric hanging basket body are connected to the skeleton belt by stitching.

3. The hanging basket chair according to claim 1, wherein the connecting ring of the upper part of the skeleton belt is formed by stitching the belt.

4. The hanging basket chair according to claim 1, wherein the hanging basket chair further comprises a seat cushion which is positioned at the bottom of the inside of the fabric hanging basket body.

5. The hanging basket chair according to claim 1, wherein the hanging basket part is shaped as a cartoon animal, and the top fabric decoration body is shaped as an animal head or rump.

6. The hanging basket chair according to claim 1, wherein the top fabric decoration body is internally filled with elastic fillers.

7. The hanging basket chair according to claim 1, wherein the top fabric decoration body is connected to the fabric hanging basket body by stitching, the skeleton belt penetrates through the stitching between the top fabric decoration body and the fabric hanging basket body, forming the annular pocket mouth brim.

8. The hanging basket chair according to claim 1, wherein the hanging basket chair is further provided with a hanging basket chair support for hooking the connecting ring.

* * * * *